United States Patent [19]

Larson et al.

[11] 4,326,885

[45] Apr. 27, 1982

[54] PRECIPITATION HARDENING CHROMIUM STEEL CASTING ALLOY

[75] Inventors: John A. Larson; Robert B. Fischer, both of Easton, Pa.

[73] Assignee: Ingersoll-Rand Company, Woodcliff Lake, N.J.

[21] Appl. No.: 159,913

[22] Filed: Jun. 16, 1980

[51] Int. Cl.[3] ..... C22C 38/16

[52] U.S. Cl. ..... 75/125; 75/126 C; 75/128 R; 148/37

[58] Field of Search ..... 75/125, 126 C, 128 R; 148/37, 134, 135, 142

[56] References Cited

U.S. PATENT DOCUMENTS

| | | | |
|---|---|---|---|
| 3,594,156 | 7/1971 | Leckie et al. | 75/125 |
| 3,650,731 | 3/1972 | Aggen | 75/125 |
| 3,663,208 | 5/1972 | Kirby et al. | 75/125 |
| 3,690,870 | 9/1972 | Williams | 75/125 |

*Primary Examiner*—L. Dewayne Rutledge
*Assistant Examiner*—John P. Sheehan
*Attorney, Agent, or Firm*—Walter C. Vliet

[57] ABSTRACT

A cavitation resistant, low carbon 12% chromium steel alloy utilizing a nominal 1.5% copper addition which imparts strength by a precipitation reaction. The alloy exhibits a higher strength and hardness for a given carbon content and conversely is less susceptible to casting and welding cracks and stress corrosion cracking.

4 Claims, 1 Drawing Figure

PRECIPITATION HARDENING CHROMIUM STEEL CASTING ALLOY

BACKGROUND OF THE INVENTION

The American Casting Institutes' classical 12% chromium steel alloy designated as ACI CA-15 has been used for many years in the casting industry. It has always had serious disadvantages, particularly at higher carbon levels. These disadvantages include poor casting behavior, poor weldability and lower impact properties. The primary factor responsible for this condition is the relatively high allowable carbon content, which is in the order of 0.15%. It is well known that this level of carbon requires special handling in the foundry to remove gates and risers. In addition, preheat is necessary when welding to prevent cold cracking due to hard martensite formation in the heat affected zone.

Also it is known from field experience that with normal tempering temperatures, the cavitation resistance in equipment, such as pumps, or pump impellers, is not good. It is also known that cavitation resistance in general is a function of the hardness of the alloy, and in general the hardness of the alloy is a function of the carbon content.

DESCRIPTION OF THE PREFERRED EMBODIMENT

Figure 1:
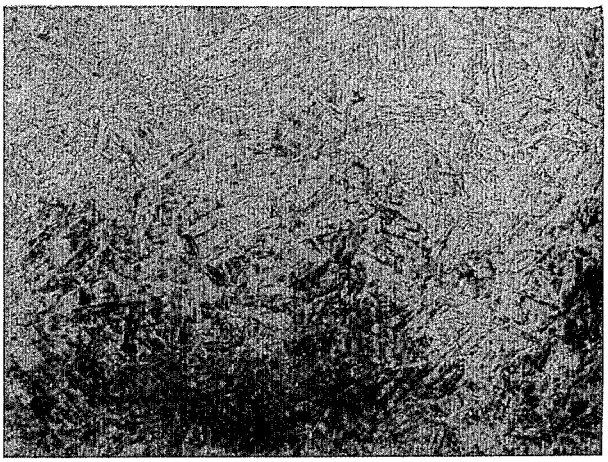
FIG. 1 shows the micro structure of the heat treated alloy according to this invention.

The cavitation resistant low carbon 12% chromium steel casting alloy according to this invention utilizes a nominal 1.5% copper addition which imparts strength by a precipitation hardening reaction. In the classical 12% chrome (ACI CA-15) casting alloy, strength and cavitation resistance are obtained by utilizing 0.10 to 0.15% carbon. With the usual tempering temperatures, and this carbon level, the hardness varies between 210 l to 250 Brinell. Although it is possible to increase the hardness by utilizing lower tempering temperatures or higher carbon contents, serious problems arise.

When lower tempering temperatures are used, for example, less than 1100° F., ductility and impact properties are drastically reduced and in boiler feed pumps handling higher purity water, the material becomes susceptible to stress corrosion cracking. If higher carbon contents, for example greater than 0.15%, are used, the material becomes impossible to cast due to the very hard and brittle as-cast properties.

In the alloy according to this invention, the carbon is kept below 0.08% carbon, and the hardness and strength required are obtained by the addition of copper. By utilizing a precipitation hardening/aging treatment, higher hardness and strength are obtained in the basically martensitic structure.

Briefly, a precipitation hardening reaction is produced in an alloy system where the solubility of the precipitation hardening element decreases with lower temperatures. At higher temperatures, the solubility must be such that the alloying element can be kept in solid solution by quenching down to room temperature. If the alloy is then reheated to a predetermined high temperature, the alloying element precipitates by a conventional nucleation and growth mechanism, usually combined with one or more of the other elements. The strength and hardness are due to the coherency strains introduced by the precipitate.

With the usual casting methods, the cooling of low carbon 12% chromium steels is such that the copper is in solid solution in the as-cast material. Thus, the material is not brittle and subject to cracking. The final strength and hardness are developed during the subsequent aging treatment. If the hardness and strength were to be obtained by using high carbon, the air hardening characteristics of the 12% chromium steel would produce a very hard brittle as-cast structure, very susceptible to cracking.

CHEMISTRY

The chemical composition of the alloy according to the present invention has an anticipated range of the following percentages of critical elements:

| | C | Mn | P | S | Si | Ni | Cr | Mo | Cu |
|---|---|---|---|---|---|---|---|---|---|
| % min. | 0.01 | | | | | | 11.5 | | 1.0 |
| % max. | 0.08 | 1.00 | 0.040 | 0.040 | 1.50 | 1.00 | 14.0 | 0.50 | 4.5 |

The alloy has a preferred range of critical elements of:

| | C | Mn | P | S | Si | Ni | Cr | Mo | Cu |
|---|---|---|---|---|---|---|---|---|---|
| % min. | 0.04 | 0.070 | | | | 0.70 | 11.5 | 0.25 | 1.40 |
| % max. | 0.07 | 1.00 | 0.040 | 0.040 | 0.50 | 1.00 | 12.5 | 0.50 | 2.00 |

In the above tables, the range of acceptable composition is given. Where no range is given, the nominal percentage range suitable for the classical ACI CA-15 casting alloy is acceptable. The balance of material in all cases is iron.

The alloy has a specific composition of critical elements as follows:

| C | Mn | P | S | Si | Ni | Cr | Mo | Cu |
|---|---|---|---|---|---|---|---|---|
| 0.06 | 0.85 | 0.02 | 0.02 | 0.30 | 0.90 | 12.0 | 0.3 | 1.75 |

HEAT TREATMENT

The above alloy having the prescribed chemical compositions require the following heat treatment to obtain the desired physical properties for a typical pump casting:

| | | | |
|---|---|---|---|
| | Anticipated Range of Heat Treatment | | |
| first; | Normalize<br>1750° F. to 1950° F.<br>1 hour/inch* | then; | Age<br>900° F.–1300° F.<br>4 hours |
| or | Preferred Range of Heat Treatment | | |
| first; | Normalize<br>1750° F.–1825° F.<br>1 hour/inch* | then; | Age<br>900° F.–1250° F.<br>4 hours |
| or | Specific Recommendation of Heat Treatment | | |
| first; | Normalize<br>1750° F.<br>1 hour/inch* | then; | Age<br>1025° F.–1050° F.<br>4 hours |

*according to standard foundry heat treating practice

PROPERTIES

The properties of the above martensitic steel casing alloy are a function of the prescribed chemistry and heat treatment procedure. The following table summarizes the properties and gives the comparison to the ASTM A217 (ACT CA-15) casting material and a material similar to CA-15, but with low carbon and no copper addition.

| Material | Age | Brinell Hardness | Reduction of Area % | Charpy V-Notch Ft. Lbs. - R.T. |
|---|---|---|---|---|
| Base 12% chromium - 0.12% carbon conforms to A217 CA-15 | 1050° F. | 280 | <45 | <11 |
| Base 12% chromium - 0.06% carbon - no copper | 1050° F. | 210 | — | — |
| New alloy - 0.06% carbon, 1.8% Cu | 1050° F. | 290 | 65 | >20 |

FOUNDRY PROCESSING

It is well known in the foundry industry that the processing of CA-15 with carbon above 0.10% is difficult due to cracking during riser removal and welding. We have simulated this processing by casting six inch cubes and evaluated the cracking tendency after riser removal. It has been found that the carbon must be kept below 0.08% to avoid cracking. The new alloy described above passes this test with no cracks, whereas the standard CA-15 exhibits severe cracking.

STRESS CORROSION

A sample of the new alloy in the form of a tensile bar was subjected to a stress corrosion test using Cortest equipment with a proof ring in a distilled water environment to simulate boiler feed pump applications. No failures were recorded after a total of 2160 hours at room temperatures at stress levels of 25 ksi, 50 ksi and 75 ksi.

CAVITATION RESISTANCE

The new steel alloy exhibits a substantially higher hardness for a given carbon content than the standard CA-15 alloy. This results in an improved cavitation resistance over the standard alloy. A particular application of the above alloy is in pump impellers and casing where the new alloy has demonstrated its superiority of standard CA-15 alloy in both physical properties and ease of casting and weldability.

MICROSTRUCTURE

The microstructure of the heat treated alloy according to this invention is shown in FIG. 1. The microphotograph shows the essentially martensitic strucuture with some isolated delta ferrite stringers. The alloy was etched with picric HCl and the photo taken at 100 magnification. In the following claims a blank means no minimum of the alloying agent specified.

We claim:

1. A martensitic steel casting alloy consisting of the following anticipated range of chemistry:

| | C | Mn | P | S | Si | Ni | Cr | Mo | Cu |
|---|---|---|---|---|---|---|---|---|---|
| % min. | 0.01 | | | | | | 11.5 | | 1.0 |
| % max. | 0.08 | 1.00 | 0.040 | 0.040 | 1.50 | 1.00 | 14.0 | 0.50 | 4.5 |

the balance of material consisting of iron.

2. A casting alloy according to claim 1 which is heat treated as follows:

| | | | |
|---|---|---|---|
| first; | Normalize<br>1750° F. to 1950° F.<br>1 hour/inch | then; | Age<br>900° F.–1300° F.<br>4 hours |

3. A casting alloy consisting of the following preferred range of chemistry:

| | C | Mn | P | S | Si | Ni | Cr | Mo | Cu |
|---|---|---|---|---|---|---|---|---|---|
| % min. | 0.04 | 0.070 | | | | 0.70 | 11.5 | 0.25 | 1.40 |
| % max. | 0.07 | 1.00 | 0.040 | 0.040 | 0.50 | 1.00 | 12.5 | 0.50 | 2.00 |

4. A chrome casting manufactured from a steel consisting of the following composition:

| C | Mn | P | S | Si | Ni | Cr | Mo | Cu | Fe |
|---|---|---|---|---|---|---|---|---|---|
| 0.06 | 0.85 | 0.02 | 0.02 | 0.30 | 0.90 | 12.0 | 0.3 | 1.75 | Balance |

having the following heat treatment:

| | | | |
|---|---|---|---|
| first; | Normalize<br>1750° F.<br>1 hour/inch | then; | Age<br>1025° F.–1050° F.<br>4 hours |

* * * * *